US011702265B2

(12) United States Patent
Liu et al.

(10) Patent No.: US 11,702,265 B2
(45) Date of Patent: Jul. 18, 2023

(54) PACKAGING STRUCTURE AND DELIVERING DEVICE

(71) Applicant: RADIANT OPTO-ELECTRONICS CORPORATION, Kaohsiung (TW)

(72) Inventors: Fang-Chun Liu, Kaohsiung (TW); Hung-Lin Chou, Kaohsiung (TW); Chao-Hsu Chen, Kaohsiung (TW); Wei-Ju Chen, Kaohsiung (TW); Shu-Juan Song, Suzhou (CN); Ren-Zhu Cao, Suzhou (CN); Tian-Yu Zhao, Suzhou (CN); Chih-Ming Chan, Kaohsiung (TW)

(73) Assignee: RADIANT OPTO-ELECTRONICS CORPORATION, Kaohsiung (TW)

( * ) Notice: Subject to any disclaimer, the term of this patent is extended or adjusted under 35 U.S.C. 154(b) by 0 days.

(21) Appl. No.: 16/933,164

(22) Filed: Jul. 20, 2020

(65) Prior Publication Data

US 2021/0024267 A1 Jan. 28, 2021

(30) Foreign Application Priority Data

Jul. 22, 2019 (TW) ..... 108125828
Mar. 18, 2020 (TW) ..... 109109034

(51) Int. Cl.
*B65D 25/10* (2006.01)
*B65D 75/38* (2006.01)
(Continued)

(52) U.S. Cl.
CPC ..... *B65D 75/38* (2013.01); *B65D 25/107* (2013.01); *B65D 61/00* (2013.01); *B65D 65/10* (2013.01); *B65D 81/054* (2013.01); *B65D 85/48* (2013.01)

(58) Field of Classification Search
CPC ..... B65D 25/107; B65D 75/38; B65D 85/48; B65D 81/054; B65D 65/10
(Continued)

(56) References Cited

U.S. PATENT DOCUMENTS 3,905,474 A 9/1975 Haibara
3,939,978 A 2/1976 Thomaswick
(Continued)

FOREIGN PATENT DOCUMENTS

CN 1207078 A 2/1999
CN 1633383 A 6/2005
(Continued)

*Primary Examiner* — Steven A. Reynolds
(74) *Attorney, Agent, or Firm* — Bacon & Thomas, PLLC

(57) ABSTRACT

A packaging structure is used for carrying at least one carried object. The packaging structure includes a carrying unit and a covering member. The carrying unit includes a supporting plate, at least one first side plate connected to the edge of the supporting plate, and at least one combing member. The supporting plate has two opposite surfaces, and the first side plate is able to bend to one of the surfaces of the supporting plate, so that the carrying unit can be folded or unfolded. The first side plate is stacked on the supporting plate when the carrying unit is in the folded state, and the combing member keeps the first side plate stacked on the supporting plate. The covering member positions the carried object on the carrying unit. A delivering device is provided for clamping and positioning a plurality of the packaging structures in an upright manner.

12 Claims, 13 Drawing Sheets

(51) Int. Cl.

| | |
|---|---|
| ***B65D 65/10*** | (2006.01) |
| ***B65D 81/05*** | (2006.01) |
| ***B65D 85/48*** | (2006.01) |
| ***B65D 61/00*** | (2006.01) |

(58) Field of Classification Search
USPC ..... 206/454, 449
See application file for complete search history.

(56) References Cited

U.S. PATENT DOCUMENTS

| | | | | |
|---|---|---|---|---|
| 4,627,223 | A | 12/1986 | Janhonen | |
| 4,865,200 | A | 9/1989 | Sullivan et al. | |
| 7,652,233 | B2 | 1/2010 | Keefe | |
| 2004/0074798 | A1* | 4/2004 | Taylor | B65D 77/042 206/583 |
| 2008/0142518 | A1* | 6/2008 | Maistrellis | A45C 13/1069 281/31 |
| 2013/0199954 | A1* | 8/2013 | Huard | B65D 85/48 206/454 |
| 2014/0097115 | A1* | 4/2014 | Kuo | B65D 81/052 206/522 |

FOREIGN PATENT DOCUMENTS

| | | | |
|---|---|---|---|
| CN | 101311077 | A | 11/2008 |
| CN | 102114946 | A | 7/2011 |
| CN | 102633065 | A | 8/2012 |
| CN | 108298197 | A | 7/2018 |
| CN | 109996741 | A | 7/2019 |
| GB | 135411 | | 12/1919 |
| GB | 1436353 | A | 5/1976 |
| JP | 2008-201449 | A | 9/2008 |
| SE | 399230 | B | 2/1978 |
| TW | 472772 | U | 1/2002 |
| TW | 2019-10210 | A | 3/2019 |

* cited by examiner

PACKAGING STRUCTURE AND DELIVERING DEVICE

RELATED APPLICATIONS

This application claims priority of Taiwanese Application No. 108125828 filed on Jul. 22, 2019 and Taiwanese Application No. 109109034 filed on Mar. 18, 2020. The entire disclosures of all the above applications are hereby incorporated by reference.

BACKGROUND OF THE INVENTION

1. Field of the Invention

The present invention relates to a packaging structure. More particularly, the present invention relates to a packaging structure and a delivering device for carrying and transporting an optical plates by the packaging structure thereto.

2. Description of the Prior Art

The vacuum forming box (commonly known as Tray) is generally used to transport the optical objects such as light guide plates or backlight modules. However, there is a need for designing different size or type of vacuum forming box for different sizes or types of the optical objects. Besides, there are abutment structures set at the four corners of the vacuum forming box to avoid the horizontal sliding of the optical objects. Therefore, the whole structure of the vacuum forming box is more complicated. In addition to reducing the volume of the vacuum forming box, the thickness of the vacuum forming box is so thin that the vacuum forming box is easy to be deformed by collision or stacking.

Furthermore, the vacuum forming box is a flat design for piling the vacuum forming boxes up to prevent the displacement of the optical objects during the transportation. However, the optical object in the lower vacuum forming box may be pressed directly by the upper vacuum forming box due to the manufacturing tolerances of the vacuum forming box, or the vacuum forming boxes may be stacked inaccurately so that an inefficient pressing might occur.

SUMMARY OF THE INVENTION

One object of the present invention is to provide a packaging structure which is capable of securely covering, adapting to different size of carried objects, and positioning by itself.

The packaging structure of the present invention, which is used to carry at least one carried object and comprises a carrying unit and a covering member. The carrying unit includes a supporting plate, at least one first side plate connected to the edge of the supporting plate, and at least one combining member. The supporting plate has two opposite surfaces, and the first side plate is able to bend toward or bend away to one of the surfaces so that the carrying unit is able to present in a folded state or an unfolded state. The first side plate is stacked on the supporting plate when the carrying unit in the folded state. The combining member keeps the first side plate stacked on the supporting plate. The covering member is used for positioning the carried object on the carrying unit.

Another object of the present invention is to provide a delivering device comprising an aforementioned packing structure for carrying and transporting an optical plates.

The delivering device of the present invention is used to clamp and position a plurality of aforementioned packaging structures in a upright manner, and includes a plurality of fixing units for clamping and positioning at least two corners respectively of each packaging structure. Each fixing unit includes an elongated body extending in the X-axis direction, and a plurality of accommodating grooves recessed on the body which is parallel with another in the Y-axis direction. The corners of each packaging structure are plugged in the accommodating grooves.

The advantage of this present invention is that the carrying unit provides sufficient support, and the covering member cooperates with the carrying unit to position the carried object. Accordingly, the packaging structure can provide a good positioning effect without stacking, and can be applied to various sizes of carried object. The delivering device can be suitable for different sizes or specifications of the packaging structures, and the packaging structures can be stored and transported in an upright manner. The delivering device can reduce the damage caused by stacking the packaging structures horizontally, and can also increase the number of storage and transport, so that manufacturing costs can be reduced.

BRIEF DESCRIPTION OF THE DRAWINGS

FIG. 8 is a side exploded view of the packaging structure shown in

FIG. 7;

DETAILED DESCRIPTION OF THE PREFERRED EMBODIMENTS

Figure 1:
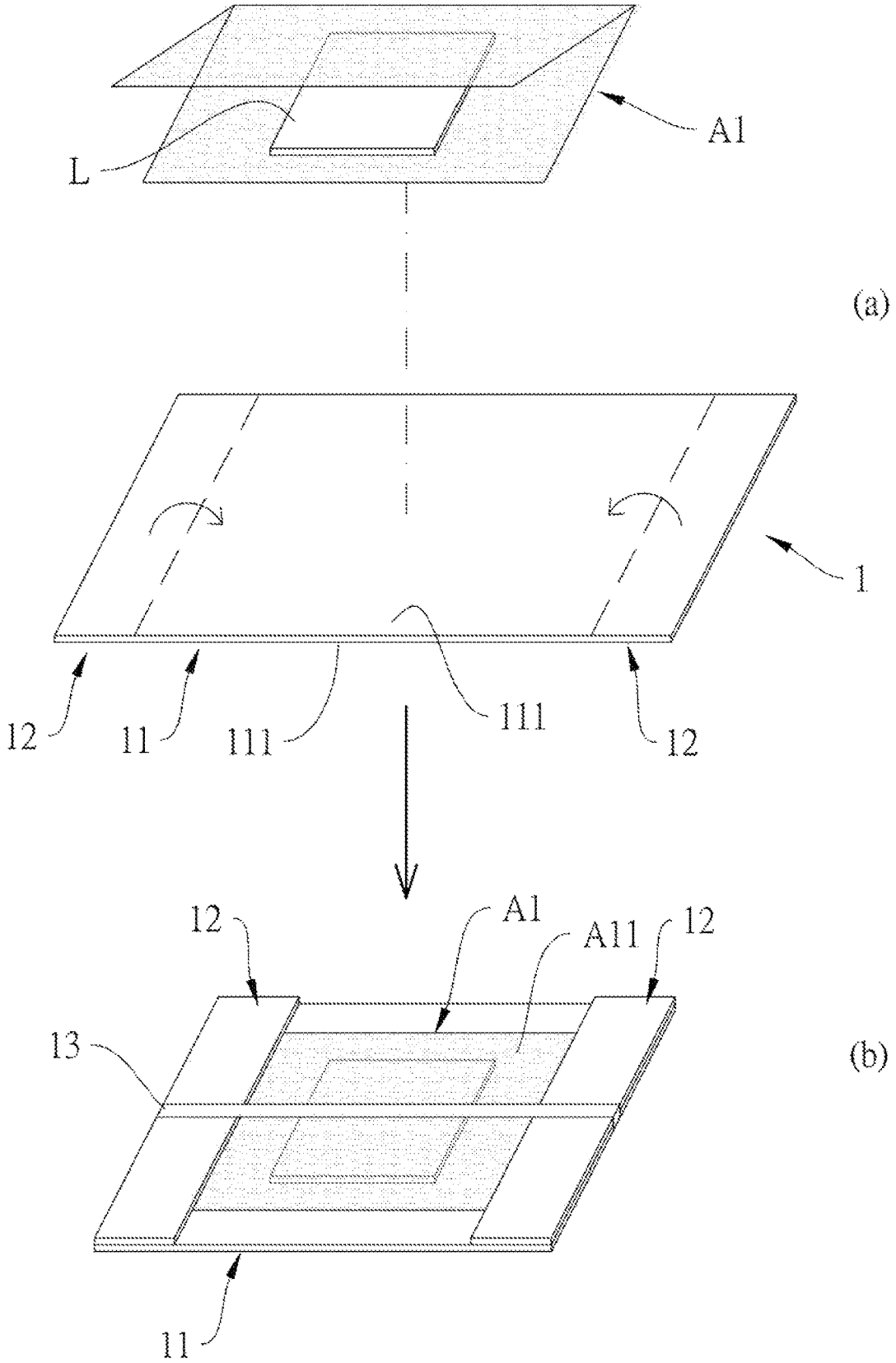
FIG. 1 is an isometric exploded view of a first preferred embodiment of a packaging structure.

Specific structural and functional details disclosed herein will become apparent from the following description of the preferred embodiments of the present invention taken in conjunction with the accompanying drawings, which provides a better understanding to a person having ordinary skill in the art but shall not be construed as limiting the invention. Wherever possible, the same reference numbers are used in the drawings and the description to refer to the same or like parts.

Referring to FIG. 1, a first preferred embodiment of the packaging structure of the present invention, comprises a carrying unit 1 and a covering member A1. The carrying unit 1 includes a rectangular supporting plate 11, two first side plates 12 connected to two opposite edges of the supporting plate 11, and a combining member 13. The supporting plate 11 has two opposite surfaces 111, and the first side plates 12 can be bent toward or bent away relative to one of the surfaces 111 of the supporting plate 11, so that the carrying unit 1 can present in a folded state or an unfolded state. The supporting plate 11 and the first side plates 12 of the carrying unit 1 can be made of reinforced and moisture-proof paperboard, wooden board or plastic plate, etc., which have better moisture tolerance and greater hardness than an carried object L, so that the supporting plate 11 can maintain its structural reliability after use.

Figure 2:
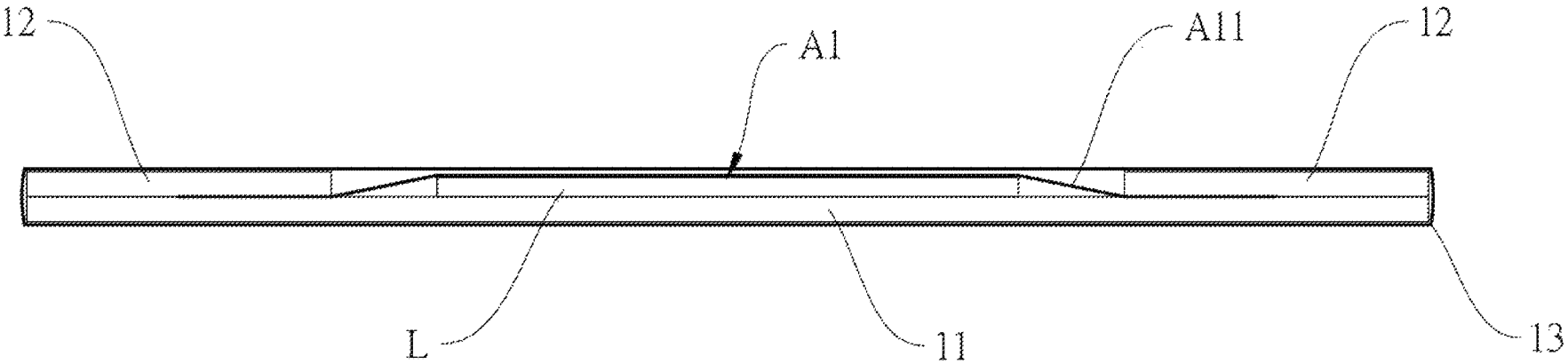
FIG. 2 is a side view of an assembly status of the packaging structure in the folded state shown in FIG. 1.

The packaging structure is used to carry the carried object L which can be an optical plate. As shown in FIG. 1(*a*), the carried object L is covered with the covering member A1 first. In this embodiment, the covering member A1 is an individual element separated from the carrying unit 1. For example, the covering member A1 can be a film or a bag, and its material is not limited to plastic products or fabrics, such as PE film (Polyethylene), PP film (Polypropylene), PVC film (Polyvinyl Chloride) or EPE film (Expandable polyethylene) etc. The film is used to explain the usage in this embodiment, but not limited thereto. After the carried object L is wrapped with the covering member A1, the covering member A1 and the carried object L are placed on the supporting plate 11 together while the carrying unit 1 presents in the unfolded state. It should be noted that a positioning portion A11 of the covering member A1 is formed beyond the region of the carried object L after the carried object L wrapped with the covering member A1 (see FIG. 1*b*). Next, both of the first side plates 12 are bent toward the same surface 111 of the supporting plate 11, so that those two first side plates 12 are stacked on the same surface 111 of the supporting plate 11, and the carrying unit 1 presents in the folded state. At this time, the positioning portion A11 of the covering member A1 is clamped and confined between the first side plate 12 and the supporting plate 11. Finally, the carrying unit 1 is kept in the folded state by the combining member 13 as shown in FIG. 1(*b*) and FIG. 2. In this embodiment, the combining member 13 is an elastic band used to bind the supporting plate 11 and the first side plates 12 together. Therefore, elastic feature of the combining member 13 can sustainably give pressure to the first side plates 12 to clamp the positioning portion A11 of the covering member A1 on the supporting plate 11, so that the carried object L can be firmly positioned on the carrying unit 1. In this embodiment, the covering member A1 can be chosen from a film that commonly used to protect the optical plates, and it does not complexify the producing process. Under the same production efficiency, as long as the conventional vacuum forming box is replaced with the packaging structure of the present invention, it is convenient for carrying the optical plates, and the packaging structures can be stacked stably, which is helpful to recycle and reuse the packaging structure of the present invention. If the carrying unit 1 is made of paper or wood, it can reduce the use of plastics and achieve the environmental protection objectives.

Figure 3:
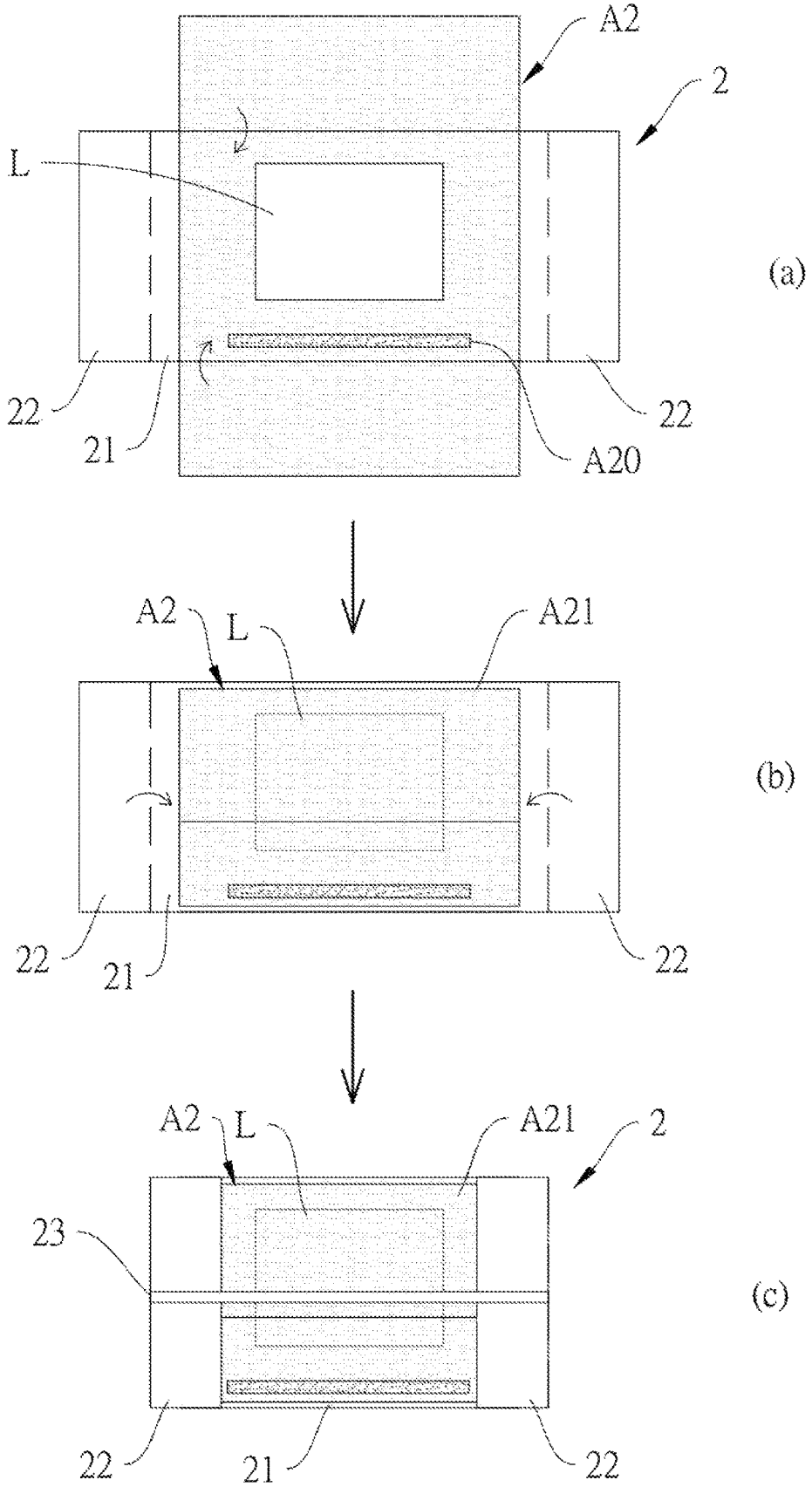
FIG. 3 is a top view of a second preferred embodiment of the packaging structure.

Referring to FIG. 3, a second preferred embodiment of the packaging structure of the present invention, comprises a carrying unit 2 and a covering member A2. The carrying unit 2 includes a rectangular supporting plate 21, two first side plates 22 connected to two opposite edges of the supporting plate 21, and a combining member 23. The first side plates 22 can be bent toward or bent away relative to the supporting plate 21, so that the carrying unit 2 can present in a folded state or an unfolded state.

In this embodiment, the covering member A2 is a transparent film and is partially combined with the supporting plate 21 to wrap a carried object L. The covering member A2 can be fixed on the supporting plate 21 by means of an adhesive layer A20 or a hook-and-loop fastener (for example, Velcro), which helps to reduce the working hours for wrapping the carried object L. If the covering member A2 is too worn to be used, it can be easily replaced with a new covering member A2. The steps of wrapping the carried object L is shown in FIG. 3(*a*). Firstly, the carried object L is placed on the covering member A2, then a portion of the covering member A2 outside the carried object L is folded to cover the carried object L. After the covering process is completed, a positioning portion A21 of the covering member A2 is formed beyond the region of the carried object L that shown in FIG. 3(*b*). Next, as shown in FIG. 3(*c*), both of the first side plates 22 are bent toward the same surface of the supporting plate 21, so that those two first side plates 22 are stacked on the same surface of the supporting plate 21 to make the carrying unit 2 presents in the folded state. At this time, the positioning portion A21 of the covering unit A2 is clamped and confined between the first side plate 22 and the supporting plate 21. Finally, the carrying unit 2 is kept in the folded state by the combining member 23 as shown in FIG. 3(*c*). In this embodiment, the combining member 23 is an elastic band used to bind the supporting plate 21 and the first side plates 22 together. Therefore, elastic feature of the combining member 23 can sustainably give pressure to the first side plates 22 to clamp the positioning portion A21 of the covering member A2 on the supporting plate 21, so that the carried object L can be firmly positioned on the carrying unit 2.

Figure 4:
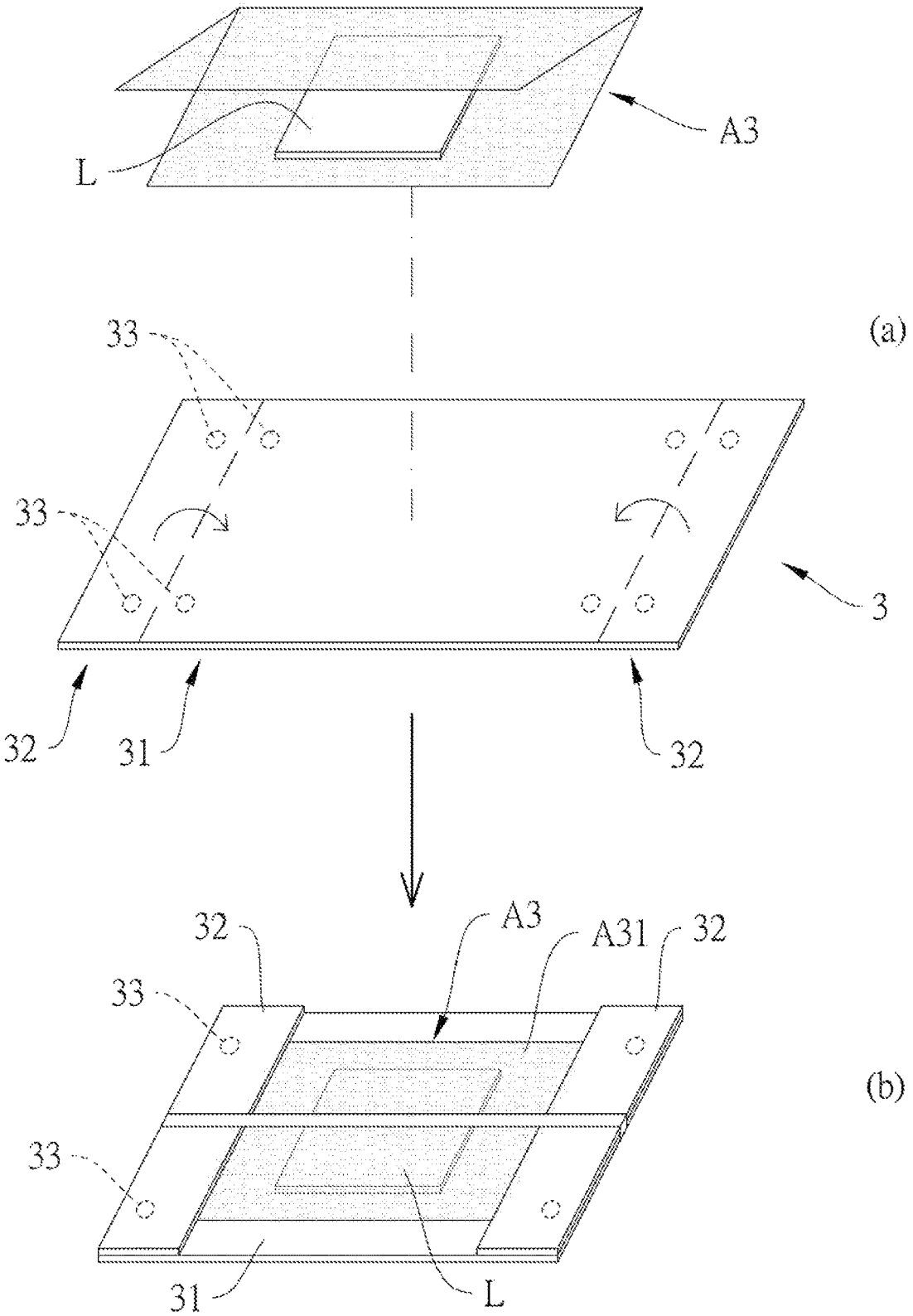
FIG. 4 is an isometric exploded view of a third preferred embodiment of the packaging structure.

Referring to FIG. 4, a third preferred embodiment of the packaging structure of the present invention, comprises a carrying unit 3 and a covering member A3. The carrying unit 3 includes a rectangular supporting plate 31, two first side plates 32 connected to two opposite edges of the supporting plate 31, and a plurality of combining members 33 respectively provided on the supporting plate 31 and each first side plate 32. Each first side plate 32 can be bent toward or bent away relative to the supporting plate 31, so that the carrying unit 3 can present in a folded state or an unfolded state.

The packaging structure of the present invention is used to carry a carried object L, which can be an optical plate. As shown in FIG. 4(*a*), the carried object L is covered with the covering member A3 first. In this embodiment, the covering member A3 is an individual element separated from the carrying unit 3. For example, the covering member A3 is a transparent film. After the carried object L is warped with the covering member A3, a positioning portion A31 of the covering member A3 is formed beyond the region of the carried object L (see FIG. 4*b*). At this time, the carrying unit 3 presents in the unfolded state. Next, both of the first side plates 32 are bent toward to the same surface of the supporting plate 31, so that those two first side plates 32 are stacked on the same surface of the supporting plate 31, and the carrying unit 3 presents in the folded state as shown in FIG. 4(*b*). The combining members 33 located on the first side plates 32 are engaged with the combing members 33 located on the supporting plate 31, so that the positioning portion A31 of the covering member A3 can be clamped and positioned.

It should be noted that each combining member 33 is a magnet in this embodiment, so the combining members 33 located on both of the first side plates 32 and the supporting plate 31 are magnetically attracted to each other. The combining members 33 are embedded in the supporting plate 31, so that the surface of the combining member 33 and the surface of the supporting plate 31 are coplanar. Similarly, the combining members 33 are embedded in the first side plates 32 and the surface of the combining members 33 is also coplanar with the surface of the first side plate 32. Therefore, without any protrusion on the surface of the supporting plate 31 nor of the first side plate 32, it is not only avoiding the accidental collision and damage of the carried object L, but also helping the first side plates 32 to be stacked on the supporting plate 31 more closely and contributing the stable stacking of a plurality of packaging structures and easy transportation.

Figure 5:
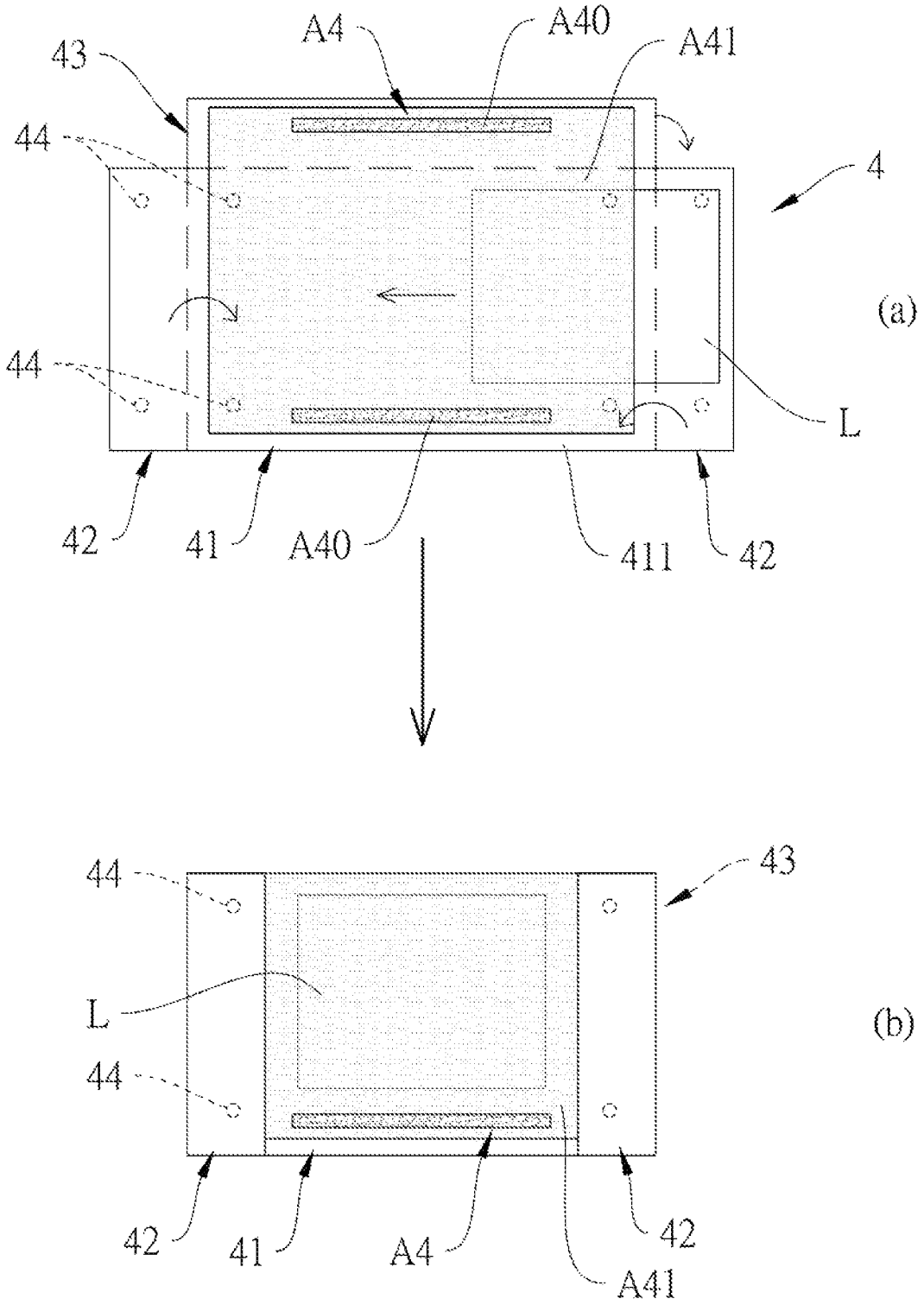
FIG. 5 is a top view of a fourth preferred embodiment of the packaging structure.

Referring to FIG. 5, a fourth preferred embodiment of the packaging structure of the present invention, comprises a carrying unit 4 and a covering member A4. The carrying unit 4 includes a rectangular supporting plate 41, two first side plates 42 connected to two opposite edges of the supporting plate 41, a second side plate 43 connected to the supporting plate 41 and located between the two first side plates 42, and a plurality of combining members 44 respectively provided on the supporting plate 41 and the first side plates 42. The supporting plate 41 has two opposite surfaces 411 (only one surface 411 is shown in FIG. 5 due to the angle of view), the first side plates 42 can be bent relative to one surface 411 of the supporting plate 41, and the second side plate 43 can be bent relative to the other surface 411 of the supporting plate 41, so that the carrying unit 4 can present in an unfolded state or a folded state. In this embodiment, at least a part of the covering member A4 (as the attaching area A40 shown in FIG. 5) is fixed on one surface 411 of the supporting plate 41, and at least another part of the covering member A4 is fixed on the second side plate 43. The covering member A4 can be fixed on the supporting plate 41 and the second side plate 43 by means of sticking or hook-and-loop fastener.

When carrying a carried object L, the carried object L is sliding laterally into the gap between the covering member A4 and the supporting plate 41 as shown in FIG. 5(*a*). Then, the second side plate 43 is bent toward the surface of the supporting plate 41 which is not combined with the covering member A4. As the second side plate 43 is bent over, the covering member A4 is slightly stretched to press on the carried object L. Since the area of the covering member A4 is larger than the area of the carried object L, a positioning portion A41 of the covering member A4 is formed beyond the region of the carried object L. Next, both of the first side plates 42 are bent in the same direction relative to the supporting plate 41, that is, the first side plates 42 are bent toward the surface of the supporting plate 41 where the covering member A4 is combined with and stacked on the supporting plate 41, so that the carrying unit 4 can present in a folded state as shown in FIG. 5(*b*). In this embodiment, the combining members 44 are magnets, the combining member 44 located on the first side plates 42 and the combining member 44 located on the supporting plate 41 are engaged with each other to clamp and position the positioning portion A41 of the covering member A4. At the same time, the first side plates 42 can also block both sides of the covering member A4 to prevent the carried object L sliding out. In addition, the first side plates 42 can also prevent contamination or foreign matter from entering the space between the covering member A4 and the supporting plate 41. In some embodiments, the combining members 44 can be a set of snap buttons, and it can also make the first side plates 42 stacked stably on the supporting plate 41 when the carrying unit 4 is in a folded state. It should be noted that, in this embodiment, the two ends of the covering member A4 are fixed to the supporting plate 41 and the second side plate 43 respectively. When the second side plate 43 is in the unfolded state, there is an accommodating space between the covering member A4 and the supporting plate 41, which is convenient for the operators to slide the carried object L into the accommodating space and place the carried object L on the supporting plate 41. After the setting of the carried object L, the operators only need to bend the first side plates 42 and the second side plate 43 on the supporting plate 41 as in the folded state, the wrapping operation of the carried object L is completed. Therefore, this embodiment can provide higher production efficiency.

Figure 6:
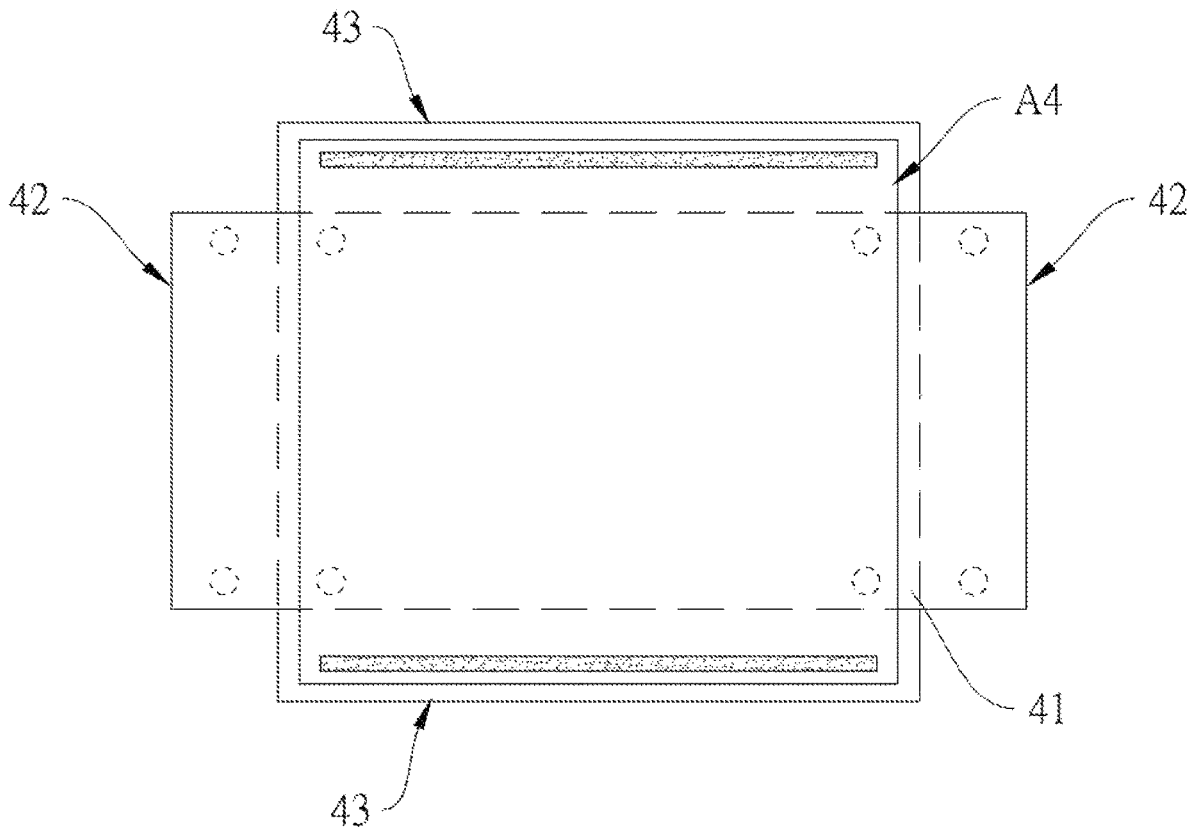
FIG. 6 is a top view of another type of the fourth preferred embodiment.

Another type of the packaging structure can be shown in FIG. 6. The first side plates 42 are provided on the left and right edges of the supporting plate 41, and the number of the second side plate 43 is two, which are provided on the upper and lower edges of the supporting plate 41. The two ends of the covering member A4 are fixed to the second side plates 43 respectively. The instruction of this embodiment is the same as shown in FIG. 5, that is, the second side plates 43 are bent downward, and the first side plates 42 are bent upward. The detailed operation process will not be described further hereinafter. In this embodiment, both ends of the covering member A4 are disposed on both of the second side plates 43 respectively. When the second side plates 43 are folded, the covering member A4 has a better pressing effect on the carried object L, and the carried object L will not slide easily.

Figure 7:
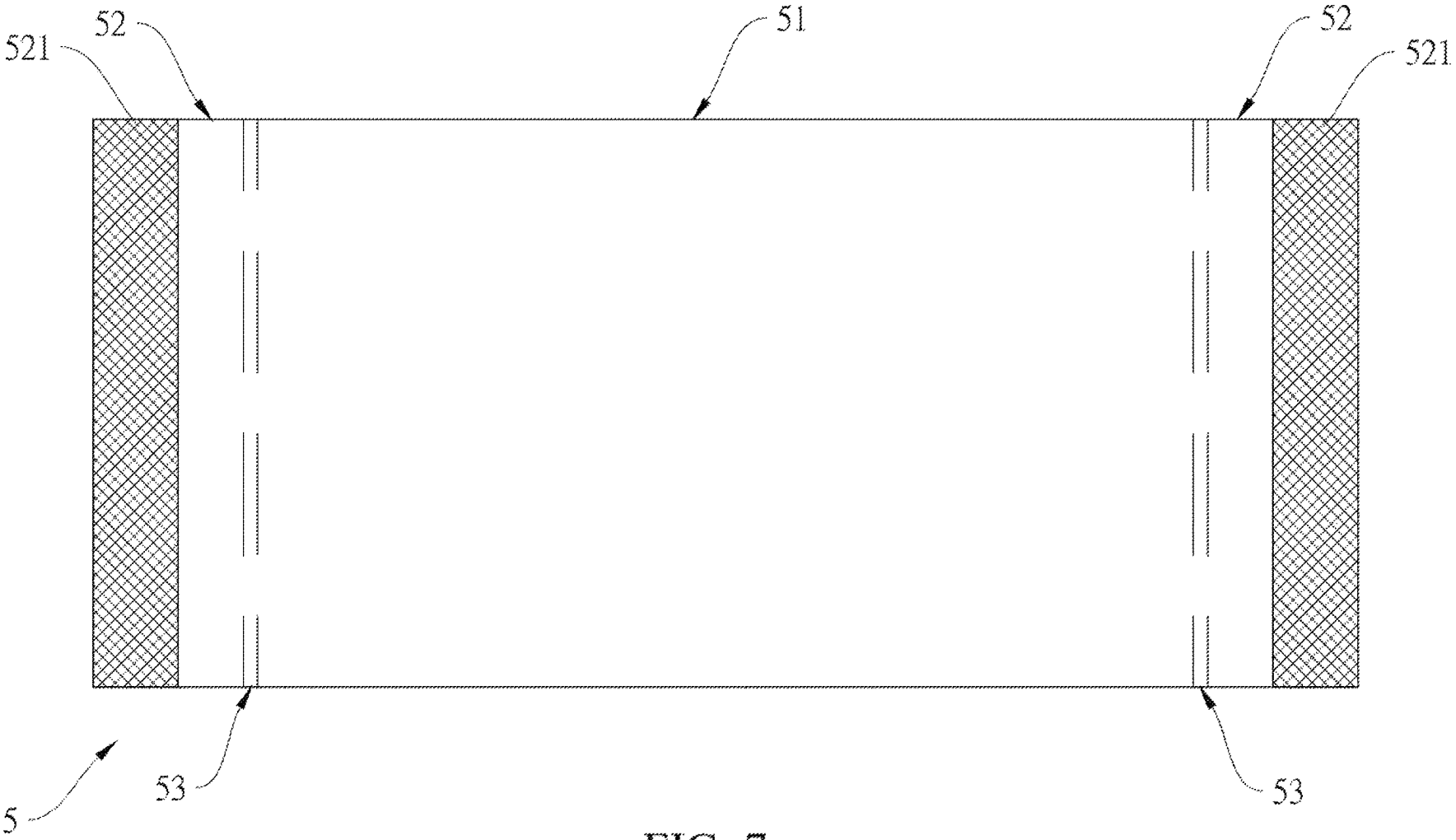
FIG. 7 is a top view of a fifth preferred embodiment of the packaging structure.
Figure 8:
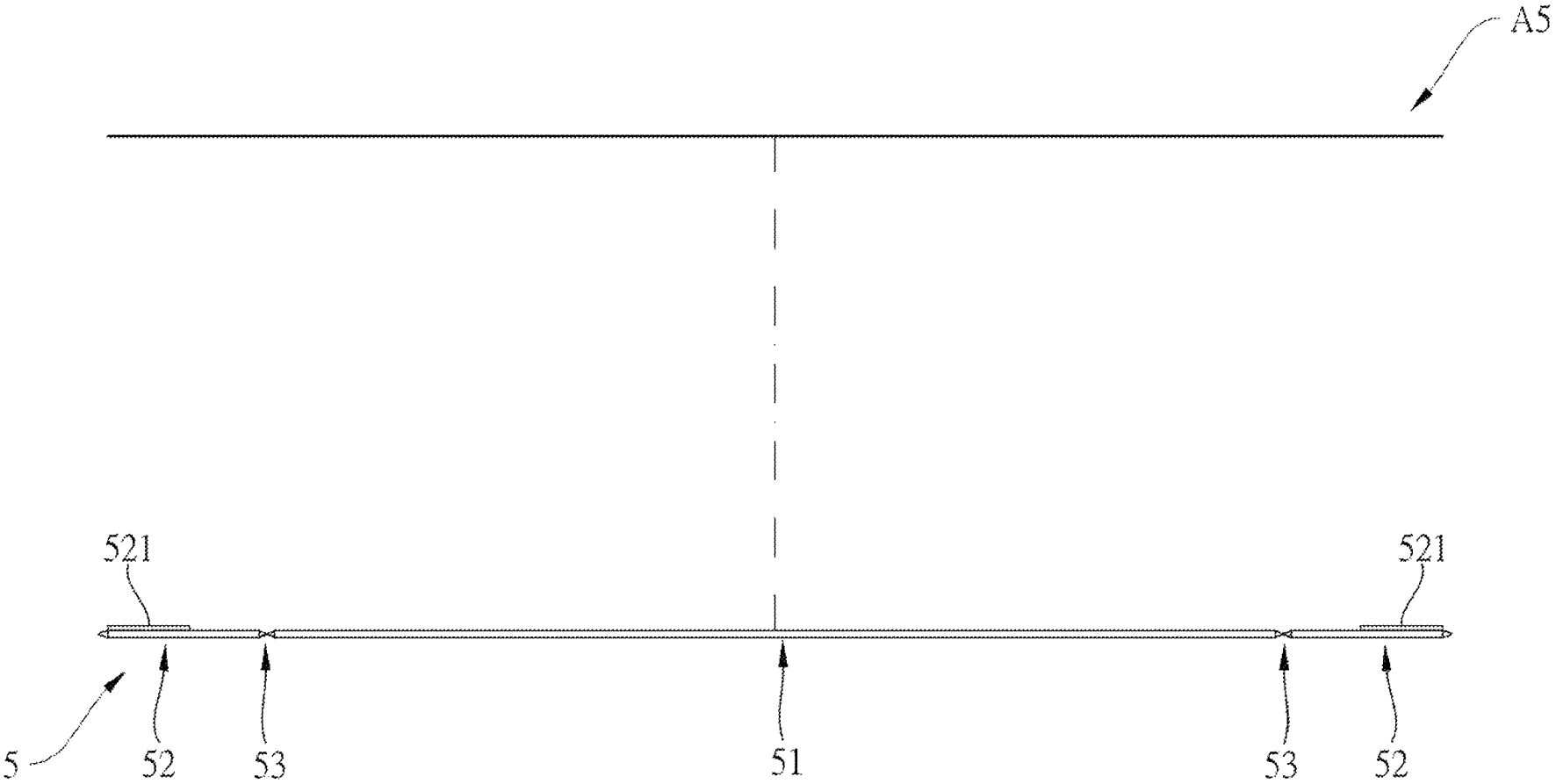

Referring to FIGS. 7 and 8, a fifth preferred embodiment of the packaging structure of the present invention, comprises a carrying unit 5 and a stretchable film A5 disposed on the carrying unit 5.

The carrying unit 5 includes a supporting plate 51 and two side plates 52 respectively connected to two opposite edges of the supporting plate 51, and the side plates 52 is capable of being bent relative to the supporting plate 51. The two sides of the film A5 are fixed on the ends of the two side plates 52 away from the supporting plate 51 respectively. As shown in FIG. 7, the outer part of each side plates 52 has a glued area 521, so that the two sides of the film A5 are adhered on the glued areas 521 respectively. The film A5 can also be fixed on both sides of the supporting plate 51 by nailing or buckling, which shall not be construed as limiting the invention.

Figure 9:
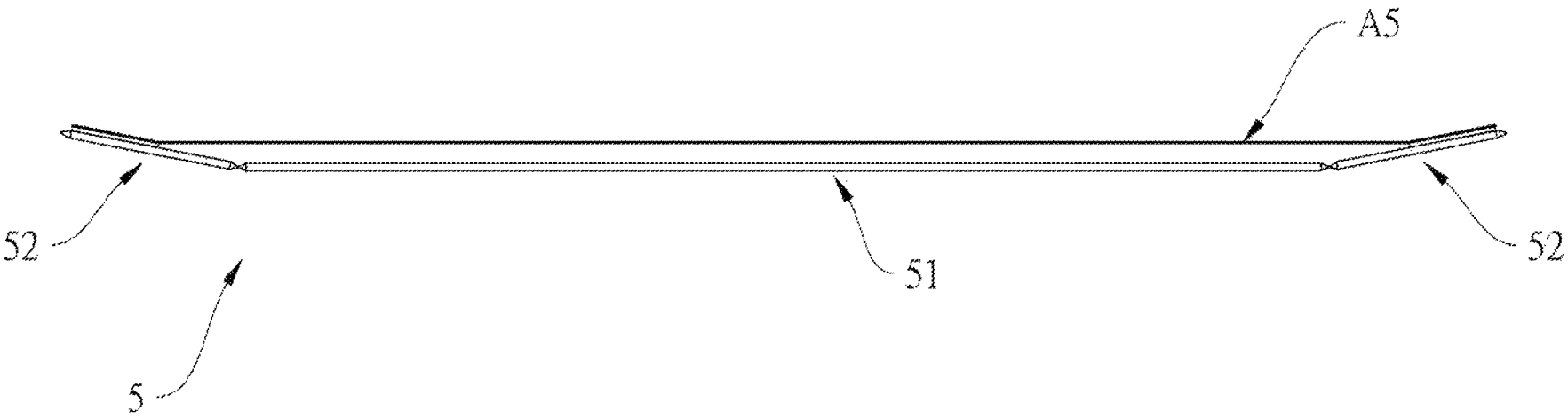
FIG. 9 is a side view of an assembly status of the packaging structure shown in FIG. 8.

Referring to FIG. 8, the ratio of the length of the film A5 to the length of the carrying unit 5 is 0.9 to 0.97:1, that is, the length of the film A5 is slightly shorter than the total length of the carrying unit 5. When the two sides of the film A5 are fixed to the carrying unit 5, outer part of the two side plates 52 will be slightly pulled upward due to the elasticity of the film A5 as shown in FIG. 9, and a gap is formed between the film A5 and the supporting plate 51. This gap is used to allow the carried object L (see FIG. 10) such as an optical plate to enter or exit, and the carried object L can be placed on a holding surface of the supporting plate 51. In order to achieve a good holding effect, the hardness of the supporting plate 51 must be greater than the carried object L. At the same time, the area of the supporting plate 51 must also be greater than the area of the carried object L. In this embodiment, the supporting plate 51 and the two side plates 52 can be made of paperboard, wood board or plastic board, but it is not limited thereto.

Figure 10:
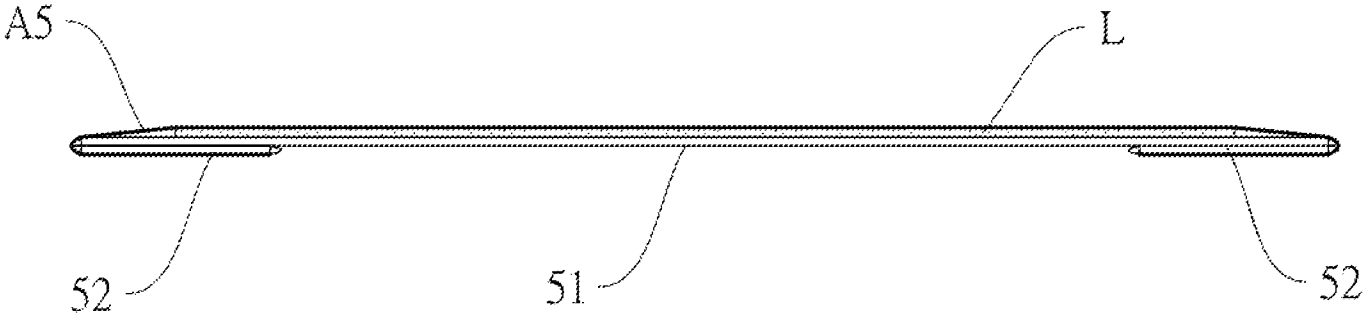
FIG. 10 is a side view of the packaging structure in the folded state shown in FIG. 9.

When in actual implementation, the carried object L is placed on the supporting plate 51 through the gap between the film A5 and the supporting plate 51, and the two side plates 52 are bent toward the other surface opposite to the holding surface of the supporting plate 51 as shown in FIG. 10. At this time, the film A5 is simultaneously stretched, and the carried object L is clamped and positioned between the film A5 and the supporting plate 51.

In addition, in order to enhance the positioning effect of the carried object L, a plurality of microstructures are formed on a surface of the film A5 facing the carrying unit 5. In this embodiment, the microstructures are similar to a snake skin pattern, and the slip resistance of the contacting surface of the carrying unit 5 is ≥R11 (refer to DIN 51130, the greater slip resistance, the better the anti-slip effect). The microstructures of the film A5 and the slip resistance of the carrying unit 5 can improve the fixing effect and prevent the carried object L from scratching due to the sliding on the supporting plate 51. It should be noted that to achieve the slip resistance ≥R11 of the carrying unit 5, the surface of the carrying unit 5 that contacts the film A5 may undergo a surface treatment such as roughness, or stick a anti-slip membrane to increase resistance, such as PE film (Polyethylene), PP film (Polypropylene), PVC film (Polyvinyl Chloride) or EPE film (Expandable polyethylene), etc., but not limited thereto.

When taking the carried object L out of the carrying unit 5, the two side plates 52 are bent relative to the supporting plate 51 from the state shown in FIG. 10 to the state shown in FIG. 9, and then the carrying unit 5 is tilted, the carried object L can slide out from the gap between the film A5 and the supporting plate 51. In this embodiment, it is recommended that the film A5 is a non-sticky material, and the surface electric resistance is $\leq 10^{10}\Omega$, so the film A5 will not attach to the carried object L, and the carried object L can slide smoothly out of the carrying unit 5.

It is noted that as shown in FIG. 8, in this embodiment, the two side plates 52 are connected to two opposite edges of the supporting plate 51, and in order to allow the two side plates 52 to be bent relative to the supporting plate 51, the connector 53 between each side plate 52 and the supporting plate 51 can be very thin or has a cutting line, so that the two side plates 52 can be bent easily.

Figure 11:
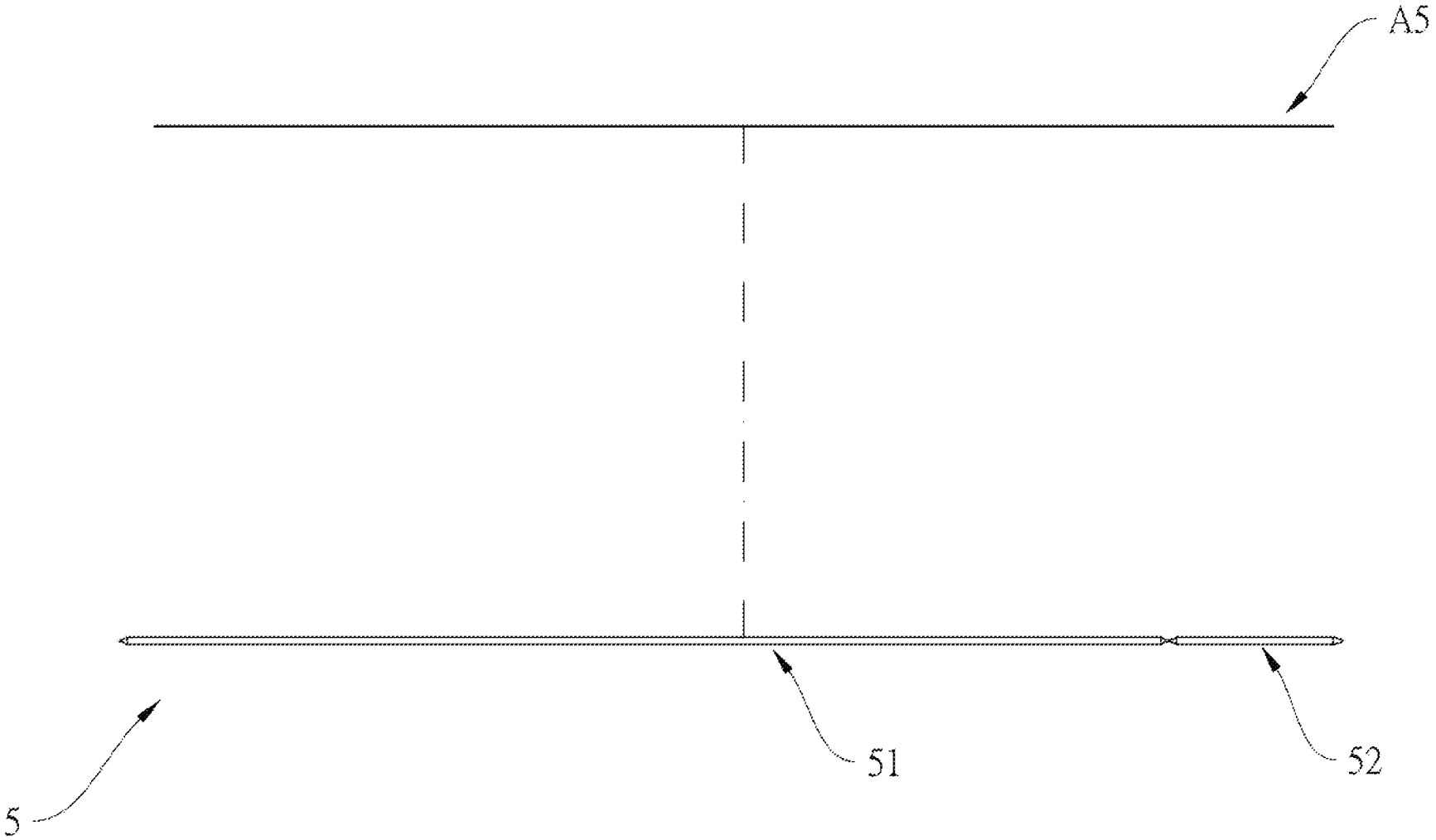
FIG. 11 is a side exploded view of another type of the fifth preferred embodiment.

In addition, in this embodiment, there are two side plates 52 which are connected to two edges of the supporting plate 51 respectively. In other embodiment, as shown in FIG. 11, only one side plate 52 is connected to one edge of the supporting plate 51, and one side of the film A5 is fixed to the end of the supporting plate 51 away from the side plate 52, and the other side of the film A5 is fixed to the end of the side plate 52 away from the supporting plate 51. In this way, the aforementioned effect of positioning the carried object L can also be achieved, and it can simplify the structure and reduce the manufacturing cost.

Figure 12:
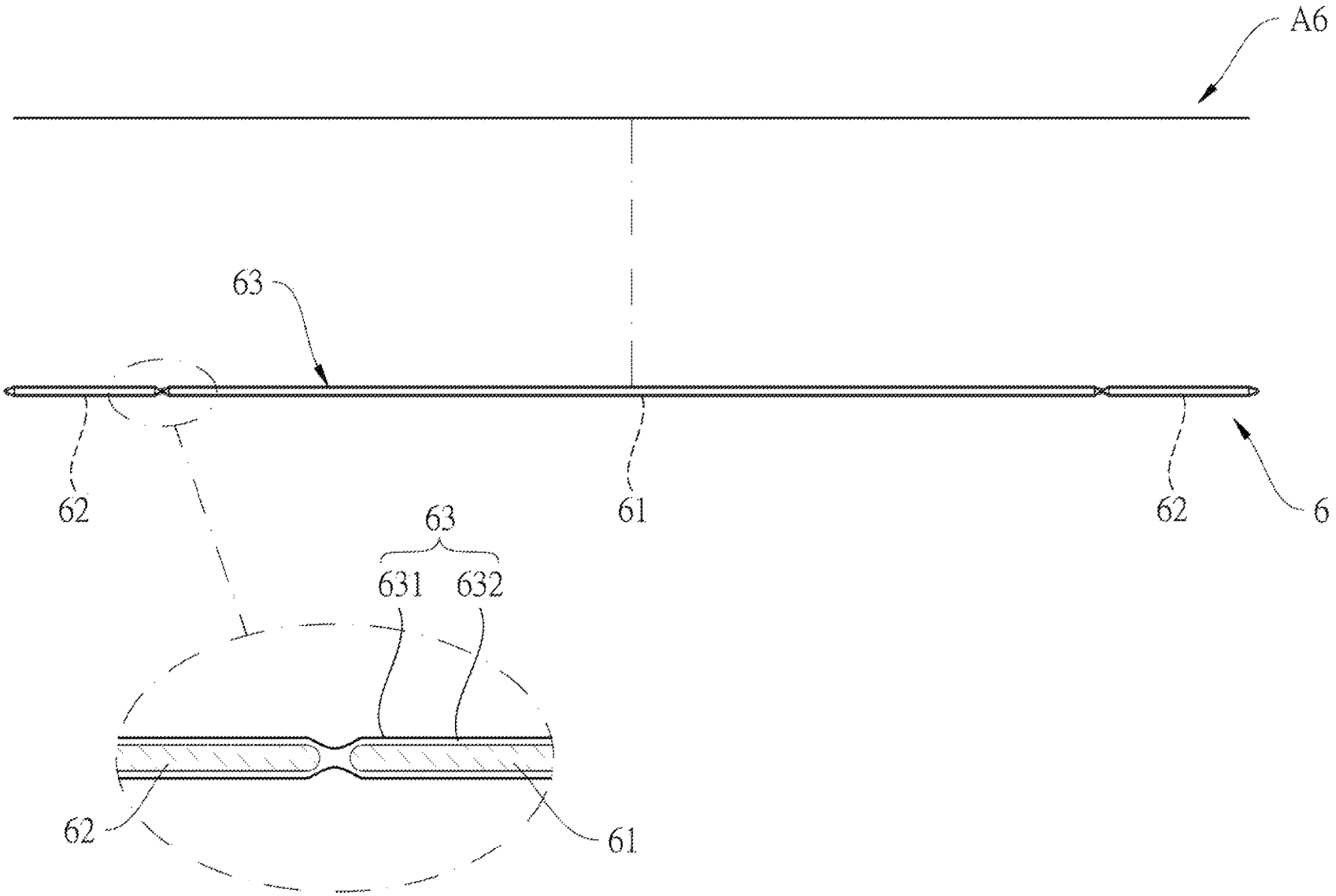
FIG. 12 is a side exploded view of a sixth preferred embodiment of the packaging structure.

Referring to FIG. 12, a sixth preferred embodiment of the packaging structure of the present invention, comprises a carrying unit 6 and a stretchable film A6 disposed on the carrying unit 6. The carrying unit 6 includes a supporting plate 61, two side plates 62 located on two opposite sides of the supporting plate 61, and a cladding layer 63 that tightly covers the supporting plate 61 and the two side plates 62. The two side plates 62 are not directly connected to the supporting plate 61, but have a gap with the supporting plate 61, and the side plates 62 and the supporting plate 61 are covered with the cladding layer 63 to become one-piece, so that the side plates 62 can be bent relative to the supporting plate 31. The two sides of the film A6 are respectively disposed on the ends of the cladding layer 63, which are corresponding to the ends of the two side plates 62 away from the supporting plate 61.

It should be noted that the supporting plate 61 and the side plates 62 can be made of reinforced and moisture-proof paperboard, or materials with better moisture tolerance, such as wood or plastic plates, to maintain the structural reliability of the supporting plate 61 after use. The cladding layer 63 is a coated paper 632 with an anti-slip film 631, and the carried object L is contact with the anti-slip film 631. The anti-slip film 631 can be, for example, PE film (Polyethylene), PP film (Polypropylene), PVC film (Polyvinyl Chloride) or EPE film (Expandable polyethylene), etc., but not limited thereto.

The instruction of this embodiment are the same as those of the fifth preferred embodiment. Therefore, this embodiment has the same effect by bending the side plates 62 to stretch the film A6, so as to press and position the carried object by the film A6 (not shown in FIG. 12).

Similarly, in other embodiment, the side plate 62 can be provided only on one side of the supporting plate 61 like as FIG. 11, and then the supporting plate 61 and the side plate 62 can be tightly covered with the cladding layer 63. The structure mentioned above can be understood by a person having ordinary skill in the art and the further details will not be shown in the drawing. In this way, the effect of positioning the carried objects can also be achieved, and can simplify the structure and reduce the manufacturing cost.

Figure 13:
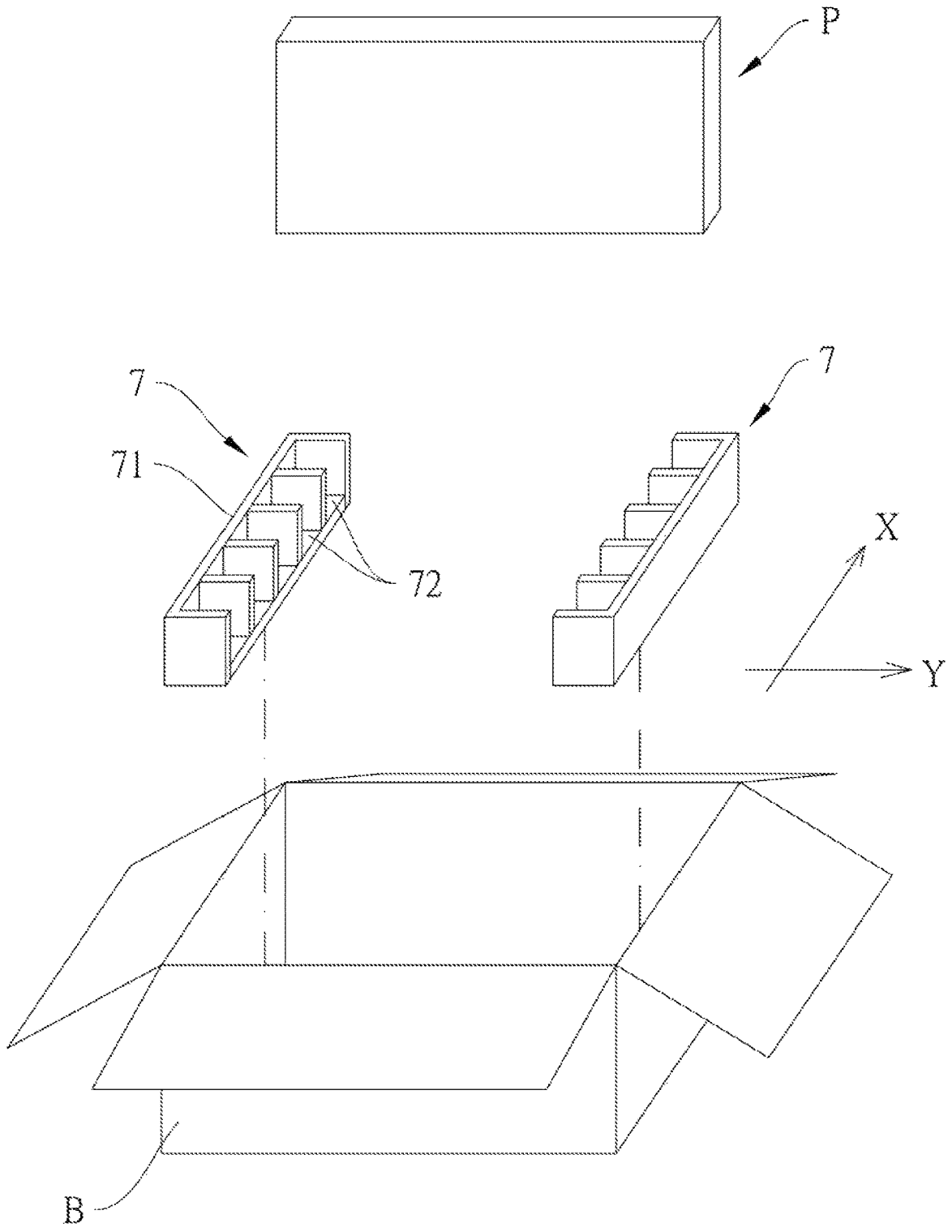
FIG. 13 is an isometric exploded view of a preferred embodiment of a delivering device.

Referring to FIG. 13, it is a preferred embodiment of a delivering device of the present invention, which is used to clamp and position a plurality of packaging structures as described above in an upright manner. The delivering device includes a plurality of fixing units 7, wherein each fixing unit 7 includes an elongated body 71 extending along the X-axis direction, and a plurality of accommodating grooves 72 arranged on the body 71 along the X-axis direction. In this embodiment, two fixing units 7 are placed at two opposite corners of a box B, and each accommodating groove 72 of each fixing unit 7 extends along the Y-axis direction and faces the accommodating groove 72 of another fixing unit 7 located on the opposite side. The fixing units 7 are used for inserting and positioning the two corners of each packaging structure. The X-axis direction intersects the Y-axis direction, and in this embodiment, the X-axis direction is perpendicular to the Y-axis direction.

While packing the packaging structures in the delivering device, first step is take two fixing units 7 placed at two opposite corners of a box B, second step is a plurality of the packaging structures are packaged into an assembly P, and then the two corners at the bottom of each assembly P are placed in the corresponding accommodating grooves 72 of the corresponding fixing unit 7 respectively so that the assembly P will be clamped and positioned. It should be noted that, the number of the packaging structures in one assembly P depends on the width of the accommodating groove 72. If the width of the accommodating groove 72 is smaller, each packaging structure can also be placed individually, and it is not necessary to pack the plural packaging structures into the assembly P.

Finally, more two fixing units 7 are respectively provided at another two corners at the top of the assembly P, so that the four corners of the assembly P are all accommodated and positioned in the accommodating grooves 72 of the four fixing units 7 for full protection and positioning.

When the carried object L (optical plate) is placed inside the packaging structure, the packaging structure can be upright and spaced apart by the above design, which not only increases the number of storages, but also avoids damages of the carried object, such as optical plates. Furthermore, each accommodating groove 72 elongates in the Y-axis direction, so it can be placed and positioned with different sizes of the assembly P or the packaging structure. There is no need to produce different-sized delivering devices according to the various sizes of packaging structures, so that the manufacturing cost and the storage space can be reduced.

In summary, regarding to the packaging structure of the present invention, as long as the carried object is completely wrapped with the covering member and then placed on the carrying unit, and different types of combining members are used to make the carrying unit present in the folded state, the carried object can be positioned stably on the supporting plate for transportation. Furthermore, with the structure of the delivering device of the present invention, it can be applied to different sizes or specifications of the packaging structures, and the packaging structures can be stored and transported in an upright manner to reduce possible damage caused by stacking, and the number of storage and transport can be increased to reduce the manufacturing costs.

Although the present invention has been explained in relation to its preferred embodiments, it is to be understood that many other possible modifications and variations can be made without departing from the scope of the invention as hereinafter claimed.

What is claimed is:

1. A packaging structure for carrying at least one carried object, and the packaging structure comprising:

a carrying unit including a supporting plate, at least one first side plate connected to one edge of the supporting plate, and at least one combining member, wherein the supporting plate has two surfaces opposite to each other, and the at least one first side plate is able to bend toward or bend away relative to one of the surfaces, so that the carrying unit is able to present in a folded state or an unfolded state, and the at least one first side plate and the at least one carried object are stacked on a same surface of the supporting plate when the carrying unit presents in the folded state, and the at least one combining member keeps the at least one first side plate stacked on the supporting plate; and a covering member used for positioning the at least one carried object on the carrying unit;

wherein the at least one carried object is covered with the covering member;

wherein at least one positioning portion of the covering member is formed beyond the region of the at least one carried object, and wherein, in the folded state, the at least one positioning portion of the covering member is sandwiched between the at least one first side plate and the supporting plate, and the at least one carried object is not overlapped by the at least one first side plate.

2. The packaging structure as claimed in claim 1, wherein the supporting plate is rectangular, and the carrying unit further includes at least one second side plate connected to the edge of the supporting plate, when the at least one first side plate is bent to one surface of the supporting plate, the second side plate is bent to the other surface of the supporting plate.

3. The packaging structure as claimed in claim 2, wherein at least one part of the covering member is fixed on the supporting plate of the carrying unit.

4. The packaging structure as claimed in claim 3, wherein another part of the covering member is fixed on the second side plate of the carrying unit, and the at least one carried object is positioned between the carrying unit and the covering member.

5. The packaging structure as claimed in claim 1, wherein the at least one combining member is an elastic band used to bind the carrying unit to make the at least one first side plate remain in the folded state.

6. The packaging structure as claimed in claim 1, wherein the number of the at least one combining member is plural, which are respectively disposed on the supporting plate and the at least one first side plate, and the combining member on the at least one first side plate is engaged with the combining member on the supporting plate when the carrying unit presents in the folded state, so that the positioning portion of the covering member can be clamped and positioned by the combining members.

7. The packaging structure as claimed in claim 6, wherein the surface of the combining member embedded in the supporting plate is coplanar with the surface of the supporting plate, and the surface of the combining member embedded in the at least one first side plate is coplanar with the surface of the at least one first side plate.

8. The packaging structure as claimed in claim 6, wherein the combining members are selected from magnets or snap buttons.

9. The packaging structure as claimed in claim 8, wherein the covering member wraps the carried object, and the positioning portion of the covering member is confined between the combining members on the at least one first side plate and on the supporting plate when the carrying unit presents in the folded state.

10. A delivering device for clamping and positioning a plurality of packaging structures as claimed in claim 1 in an upright manner, the delivering device includes a plurality of fixing units for clamping and positioning respectively at least two corners of each of the packaging structures, wherein each of the fixing units includes an elongated body extending along the X-axis direction, and a plurality of accommodating grooves arranged on the elongated body along the X-axis direction, the corners of the packaging structure are inserted in those accommodating grooves.

11. The delivering device as claimed in claim 10, wherein each of the accommodating grooves of the elongated body corresponds to each of the accommodating grooves of the elongated body along the Y-axis direction at opposite side, and at least two corners of each of the packaging structures or an assembly of the packaging structures is able to be inserted and positioned respectively in the accommodating grooves.

12. The packaging structure as claimed in claim 1, wherein a height of the at least one carried object is smaller than a thickness of the at least one first side plate.

* * * * *